United States Patent [19]

Mannara

[11] 3,952,782

[45] Apr. 27, 1976

[54] APPARATUS FOR FILLING CONTAINERS WITH COMPOSITE FLUENT MATERIAL

[75] Inventor: Giuseppe Mannara, Rome, Italy

[73] Assignee: Colgate-Palmolive Company, New York, N.Y.

[22] Filed: Mar. 5, 1975

[21] Appl. No.: 555,634

Related U.S. Application Data

[63] Continuation-in-part of Ser. No. 419,624, Nov. 28, 1973, Pat. No. 3,881,529.

[52] U.S. Cl. ..... 141/100; 239/431

[51] Int. Cl.[2] ..... B67C 3/02; B05B 7/00

[58] Field of Search ..... 239/1, 11, 418, 429, 239/430–434, 434.5; 222/1, 94; 141/9, 100, 105, 263, 275, 311–313, 317, 319–321, 374

[56] References Cited

UNITED STATES PATENTS

| | | | |
|---|---|---|---|
| 1,639,699 | 8/1927 | Hopkins | 222/94 |
| 1,699,532 | 1/1929 | Hopkins | 222/94 |
| 2,143,661 | 1/1939 | Schrader | 141/320 X |
| 2,789,731 | 4/1957 | Marraffino | 222/94 X |
| 2,914,220 | 11/1959 | Marraffino | 222/94 X |
| 2,935,231 | 5/1960 | Paull et al. | 222/94 |
| 3,002,658 | 10/1961 | Sajda | 222/94 |
| 3,227,319 | 1/1966 | Rosier | 222/94 |
| 3,311,263 | 3/1967 | Harmon | 222/94 X |
| 3,559,700 | 2/1971 | Erickson | 141/9 |
| 3,881,529 | 5/1975 | Mannara | 239/431 X |

FOREIGN PATENTS OR APPLICATIONS

| | | | |
|---|---|---|---|
| 34,154 | 2/1925 | Denmark | 222/94 |
| 820,268 | 11/1951 | Germany | 222/94 |
| 209,920 | 1/1924 | United Kingdom | 222/94 |
| 891,027 | 3/1962 | United Kingdom | 222/94 |
| 962,757 | 7/1964 | United Kingdom | 141/100 |

*Primary Examiner*—Robert S. Ward, Jr.
*Attorney, Agent, or Firm*—Kenneth A. Koch; Murray M. Grill; Herbert S. Sylvester

[57] ABSTRACT

A nozzle assembly for filling containers such as toothpaste tubes comprises inner and outer tubular members providing a core column of one fluent paste material separated from an annular column of a second fluent paste material, with the inner tubular casing being slotted for admitting streams of the second paste material peripherally into and along the core column before discharge from the nozzle assembly, as to produce a striped effect in the discharged composite product.

10 Claims, 5 Drawing Figures

APPARATUS FOR FILLING CONTAINERS WITH COMPOSITE FLUENT MATERIAL

This is a continuation-in-part of Ser. No. 419,624 filed Nov. 28, 1973 now U.S. Pat. No. 3,881,529, issued May 6, 1975.

This invention relates to the filling of containers such as collapsible tubes with two different fluent materials in such relation that when the container is actuated for dispensing the contents will emerge with the different compositions in predetermined relative location, as for example to present a markedly distinct striped effect.

It has been proposed, see British Pat. No. 962,757, to provide a device for filling toothpaste tubes, wherein different colored pastes are separately fed through concentric nozzle tubes at the discharge ends of which the outer paste is separated into smaller streams that longitudinally and peripherally join the discharged column of inner paste to provide a longitudinally striped product in the container.

The present invention is directed to a novel nozzle construction whereby different fluent materials are more effectively introduced into coacting relation by combining them within the nozzle assembly in such manner that an improved composite product is available, and such is a major advantage of the invention.

The term fluent material as used herein includes creams, pastes, gels and like fluent materials.

A further advantage of the invention is to provide a novel nozzle assembly for filling toothpaste and like tubes or containers for producing a longitudinally arrayed composite product wherein concentric columns of different fluent materials are fed separately and coaxially toward a discharge outlet, and wherein peripherally spaced streams of the longitudinally moving outer material are forced substantially radially inwardly and peripherally into the longitudinally moving inner column in controlled relation within the nozzle assembly so that the different fluent materials are united in a single effective composite column prior to discharge through the outlet.

It is a further advantage of the invention to provide a novel nozzle assembly structure wherein a hollow central tube receiving a first fluent material is surrounded by a concentric annular passage receiving a second fluent material and the wall of the central tube is slotted or otherwise formed with orifices at circumferentially spaced intervals to continuously admit streams from the outer tube to penetrate into the inner column and form longitudinal distinct regions such as stripes therealong. Advantageous internal projections may be provided within the central tube axially above the inner end of each orifice to protect the inward flow of the second material.

PREFERRED EMBODIMENTS

Figure 1:
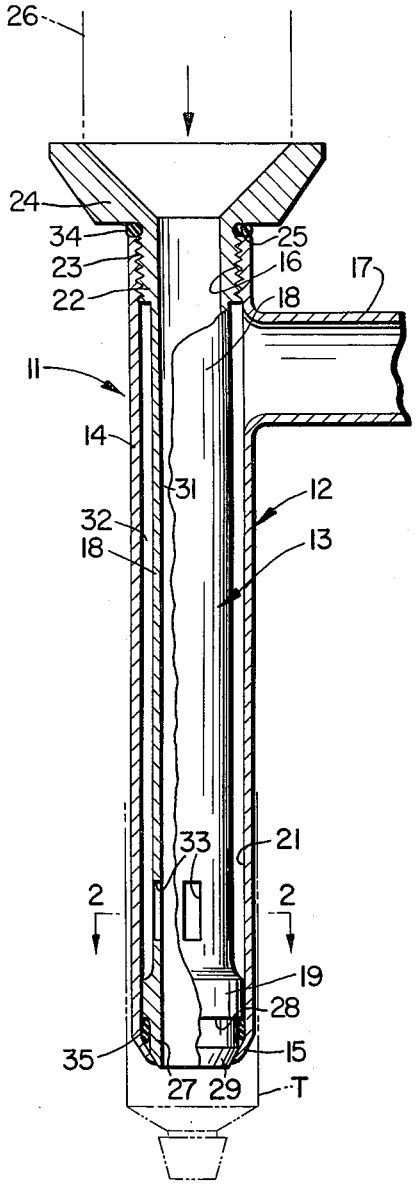
FIG. 1 is a side elevation, partly broken away and in section, showing a filling nozzle arrangement according to a preferred embodiment of the invention.
Figure 2:
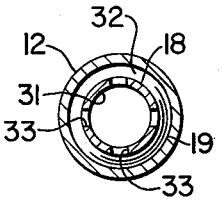
FIG. 2 is a section substantially on line 2—2 Of FIG. 1 showing internal structure.
Figure 3:
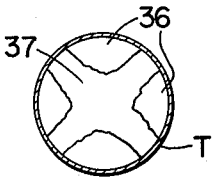
FIG. 3 is an essentially illustrative view showing a cross section of the product as it appears within the container.

Referring to FIGS. 1–3, a filling nozzle assembly 11 consists essentially of an outer tubular member 12 and a relatively fixed removable inner tubular member 13.

Outer tubular member 12 comprises a hollow cylindrical body 14 having an inturned conical open lower end 15 and an open upper end that is internally threaded at 16. Below the threaded upper end, tubular member 12 is laterally open to a connecting intake supply conduit 17 for introducing a fluent material such as a toothpaste or the like as will appear.

Inner tubular member 13 comprises a hollow cylindrical body 18 having at its lower end an enlarged diameter short cylindrical guide section 19 that has a snug sliding fit within the cylindrical bore 21 of body 14. At its upper end body 18 is formed with an enlarged diameter section 22 that is externally threaded at 23 to mate with the threads 16 of the outer member. Beyond threaded section 22, body 18 is further enlarged at 24 and provided with an annular radial surface 25 that faces downwardly. The enlarged section 24 is adapted for connection to a supply conduit indicated diagrammatically at 26 for introducing fluent material such as a toothpaste.

At its lower end, the inner member 13 below guide section 19 is formed with a reduced external diameter portion 27 defining a downwardly facing annular shoulder 28. The lower end of member 13 is externally conical at 29 where it projects through the open lower end of outer member 12. Inner member 13 has a constant diameter internal cylindrical bore 31.

The cylindrical walls of body 14 and body 18 are radially separated so as to provide an annular space 32 disposed between the threaded connection at 16, 23 and the enlarged inner section 19. Conduit 17 opens into space 32. Below the junction of conduit 17 with space 32, inner body 18 is formed with a plurality of laterally open orifices in the form of uniformly circumferentially spaced slots 33 that provide communication between space 32 and the interior of inner member 13.

The parts are so constructed and arranged that when the inner and outer members 12 and 13 are joined by the threaded connection at 16, 23 a resilient O-ring 34 will be compressed sealably between surface 25 and the upper end of outer member 12, and a resilient O-ring will be compressed sealably between shoulder 28 and the inner surface of the conical lower end of the outer member 12. This axially seals space 32 at opposite ends, so that the space is closed except for the inlet thereto at 17 and the discharge orifices 33.

In operation, two separate fluent materials typically having contrasting colors may be introduced at the same time into bore 31 and space 32 respectively. This provides a core column of one fluent material in bore 31, and an annular column of a second fluent material in space 32. Preferably these fluent materials are forced into the nozzle assembly under pump pressure; the nozzle assembly having been introduced into the interior of an open tube indicated at T in FIG. 1. The core column of fluent material flowing down the interior of member 13 is peripherally joined at the level of orifices 33 with streams of the second fluent material entering through orifices 33 from the surrounding column in space 32.

FIG. 3 illustrates a distribution of the two fluent materials within the tube T as filled. It will be understood that in accord with known practice the nozzle assembly is initially fully introduced in a conventional manner (not shown) within tube T so that at the beginning it discharges paste at the closed capped end of the tube, and as filling progresses the nozzle assembly is gradually moved upward out of the tube in a controlled manner (not shown). The conical end at 15 facilitates entry of the nozzle assembly into the tube to be filled, and the diameter of body 14 is usually a few centimeters less than the inner diameter of the tube to permit free entry while permitting discharge of an adequate column of paste into the tube T. Where a striped toothpaste is desired, pastes of different color are continuously introduced into inner member 13 and space 32 respectively, and the pattern of combination within the nozzle assembly and eventually within the tube is for example like that illustrated in FIG. 3.

Within the nozzle assembly outer circumferentially spaced streams of paste from the annular column enter the inner tubular member through orifices 33 and penetrate deeply radially into the core column stream within bore 31, and conditions may be varied to control such penetration. For example, the pressure in space 32 may be increased for deeper penetration. Should paste of one color, such as white, enter member 13, paste of another color, such as blue, may enter space 32, and the discharged column emerging at 29 of the nozzle assembly will have a central core 37 of white paste and four distinct peripherally spaced longitudinal blue regions 36. The relative locations of the core and outer regions are substantially maintained when the composite paste enters the tube and when the tube contents are discharged by the consumer.

A feature of the invention is that the discharging composite column leaving the nozzle assembly is of the same diameter as bore 31 whereby the container filling action may be closely controlled with the result that the product ultimately extruded from the tube T is more uniformly and distinctly striped.

The invention also contemplates variations in the number, size, shape and disposition of orifices 33 for attaining different composite effects and compositions.

A practical advantage of the disclosed structure is that the inner tube 13 may be periodically removed for cleansing the assembly. Another is that different inner tubes 13 having different orifice arrangements and sizes may be substituted into the outer tube assembly for different composite products while maintaining the same outer tube in the filling machine.

Figure 4:
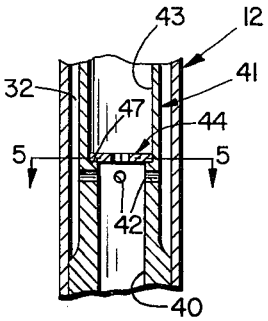
FIG. 4 is a fragmentary view in side elevation mainly in section showing an embodiment.
Figure 5:
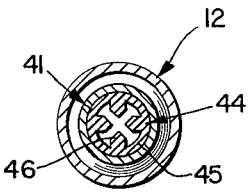
FIG. 5 is a section substantially on line 5—5 in FIG. 4.

FIGS. 4 and 5 illustrate a further embodiment wherein flow modifying means is provided within the bore of the inner tubular member. The outer tubular member 12 is the same as in FIGS. 1 and 2, and the inner tubular member 41 is of the same construction as member 13 at its upper and lower ends and its connection to the outer tubular member. Space 32 in FIG. 4 is thus essentially the same as in FIG. 1. Structurally the embodiment of FIGS. 4 and 5 distinguishes over FIGS. 1 and 2 in that the orifices 42 connecting space 32 to the interior bore 43 of the inner tubular member, as disposed below an axially fixed flow controlling insert 44 within bore 43. While orifices 42 are shown here as of circular cross section they may be slots as at 33 in FIG. 1.

Insert 44 is preferably in the form of a rigid ring 45 having four equally spaced internal projections or teeth 46. Ring 45 is frictionally fixed within bore 43 against a narrow internal axially facing annular shoulder 47 having about the same radial thickness as ring 45. The lower end 40 of bore 43 has a reduced diameter equal to the inner diameter of shoulder 47. Projections 46 are the same in number as orifices 42 and each projection 46 is preferably axially aligned with an orifice 42, whereby each projection protectively extends into the bore 43 substantially immediately above an orifice 42 so that the downward flow of paste in bore 43 is diverted from passage directly over the inner ends of orifices 42 and the paste entering bore 40 suffers less resistance to flow and more readily radially penetrates the descending column in the bore. Preferably each projection 46 has a width about equal to the diameter or width of the orifice below it. Optionally each projection 46 may be integral with the inner tubular member.

Operation in the embodiment of FIGS. 4 and 5 is essentially the same as in FIGS. 1 and 2, except for the action of the flow controlling projections in protecting the flow of paste from space 32 through the orifices into the paste column descending the bore of the inner tubular member.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A nozzle assembly for filling containers with fluent materials arranged in desired composite relation comprising longitudinally coextensive inner and outer tubular members removably secured together to form an annular space therebetween, said tubular members being threadedly connected at one end, means for introducing a first fluent material into one end of the inner tubular member, means forming a discharge opening at the other end of said inner tubular member, said inner tubular member having an enlarged portion adjacent its other end slidably fitting within the outer tube, means for introducing a second fluent material into said space, means providing a plurality of spaced orifices in said inner tubular member providing communication between said space and the interior of said inner tubular member, resilient sealing means between the tubes at opposite ends for preventing fluent material from leaving said annular space except through said orifices and axially aligned material flow modifying means disposed upstream of said orifices.

2. A nozzle assembly for filling containers with fluent materials arranged in desired composite relation comprising inner and outer tubular members secured together to form an annular space therebetween, means for introducing a first fluent material into one end of the inner tubular member, means forming a discharge opening at the other end of said inner tubular member, means for introducing a second fluent material into said annular space, means providing at least one orifice in said inner tubular member, said orifice providing communication between said annular space and the interior of said inner tubular member, sealing means at opposite ends of said tubes for preventing fluent material from leaving said annular space except through said orifice, said sealing means including an enlarged portion of said inner tubular member adjacent said other end and said orifice, said enlarged portion terminating said annular space, and axially aligned material flow modifying means disposed upstream of said orifices.

3. The nozzle assembly of claim 1 including a plurality of spaced orifices in said inner tubular member.

4. The nozzle assembly of claim 2 wherein said plurality of orifices are evenly spaced.

5. The nozzle assembly defined in claim 1, wherein said tubular members are longitudinally coextensive tubes.

6. The nozzle assembly defined in claim 1, wherein said hollow tubes are threadedly connected at one end.

7. The nozzle assembly of claim 2 wherein said flow modifying means comprises fixed internal projections on said inner tubular member adjacent the discharge end of each of said orifices.

8. The nozzle assembly of claim 7 wherein said projections are formed on an insert ring longitudinally fixed within said inner tubular member.

9. The nozzle assembly defined in claim 1, wherein said flow modifying means comprises fixed internal projections on said inner tubular member adjacent the discharge end of each orifice.

10. The nozzle assembly defined in claim 9, wherein said projections are formed on an insert ring longitudinally fixed within said inner tubular member.

* * * * *